US007516708B2

(12) United States Patent
Willy et al.

(10) Patent No.: US 7,516,708 B2
(45) Date of Patent: Apr. 14, 2009

(54) INTERLOCKING TABLE WITH INTEGRAL MAGAZINE HOLDER

(75) Inventors: Scott Willy, Carmel, IN (US); William J. LePage, Brownsburg, IN (US); Jason Shannon Slifer, Fortville, IN (US)

(73) Assignee: The Simple Furniture Company, Indianapolis, IN (US)

( * ) Notice: Subject to any disclaimer, the term of this patent is extended or adjusted under 35 U.S.C. 154(b) by 0 days.

(21) Appl. No.: 11/944,754

(22) Filed: Nov. 26, 2007

(65) Prior Publication Data

US 2008/0245277 A1 Oct. 9, 2008

Related U.S. Application Data

(63) Continuation-in-part of application No. 11/697,420, filed on Apr. 6, 2007.

(51) Int. Cl.
*A47B 13/00* (2006.01)

(52) U.S. Cl. ..... 108/157.14; 108/153.1; 211/135

(58) Field of Classification Search ..... 108/157.14, 108/157.16, 157.1, 157.12, 165, 158.12, 108/26, 25, 153.1; 211/132.1, 135, 73, 72
See application file for complete search history.

(56) References Cited

U.S. PATENT DOCUMENTS

| | | | | | |
|---|---|---|---|---|---|
| 795,957 | A * | 8/1905 | Cartland | ..... | 108/157.16 |
| 1,793,709 | A * | 2/1931 | Meyers | ..... | 108/157.16 |
| D251,886 | S | 5/1979 | Lohse | | |
| 4,191,113 | A * | 3/1980 | Hogberg | ..... | 108/157.16 |
| 4,632,040 | A * | 12/1986 | Sheffer | ..... | 108/157.14 |
| 4,632,345 | A * | 12/1986 | Barley | ..... | 108/180 |
| 4,646,927 | A * | 3/1987 | Williams et al. | ..... | 217/12 R |
| 4,807,802 | A * | 2/1989 | Williams | ..... | 217/12 R |
| 5,299,337 | A | 4/1994 | Venza | | |
| 5,370,064 | A * | 12/1994 | Sgabellone | ..... | 108/157.14 |
| 5,592,884 | A | 1/1997 | Glick et al. | | |
| 5,644,995 | A * | 7/1997 | Gurwell et al. | ..... | 108/158.12 |
| 6,152,047 | A | 11/2000 | MacNamara | | |
| 6,267,065 | B1 * | 7/2001 | Lin | ..... | 108/157.14 |
| 6,807,912 | B2 * | 10/2004 | Willy | ..... | 108/157.14 |
| D510,823 | S | 10/2005 | Ng et al. | | |
| 7,175,033 | B1 * | 2/2007 | Riopel | ..... | 211/132.1 |
| 2004/0055515 | A1 * | 3/2004 | Chen | ..... | 108/157.14 |

* cited by examiner

*Primary Examiner*—José V Chen
(74) *Attorney, Agent, or Firm*—Maginot, Moore & Beck LLP

(57) ABSTRACT

An article of furniture comprises a support assembly including an elongate cross-member, a first end panel having a top edge and an interlocking slot for engagement with an interlocking slot at one end of the cross-member, a second end panel having a top edge and an interlocking slot for engagement with the interlocking slot at the other end of the cross-member, and an intermediate support member having a pair of top edges and an interlocking slot for engagement with an interlocking slot at an intermediate portion of the cross-member. A tabletop panel is supported on the top edges of the end panels and the intermediate support. The article of furniture includes a magazine holder comprising an opening formed in the table top over an intersection point, the intersection point corresponding to a base for supporting magazines inserted through the opening.

17 Claims, 8 Drawing Sheets

INTERLOCKING TABLE WITH INTEGRAL MAGAZINE HOLDER

CROSS-REFERENCE TO RELATED APPLICATIONS

Reference is made to commonly-assigned copending U.S. patent application Ser. No. 11/697,420 filed Apr. 6, 2007, entitled "CONNECTION SYSTEM FOR FURNITURE" by Willy et al. the entire disclosure of which is expressly incorporated by reference herein.

BACKGROUND

This invention relates generally to articles of furniture. More specifically, the invention concerns furniture that is "ready-to-assemble" or knockdown.

Historically, furniture pieces are manufactured and assembled at the factory and then shipped as a complete unit to the distributor or customer. The sections of the piece are joined by large bolts which extend through predrilled holes in the sections. In some furniture, the assembly is covered with upholstery that partially conceals the bolts. The resulting assembly can be cumbersome to deliver to the customer or to simply transport from one location to another. Additionally, the size of the furniture piece may make delivery to certain locations impossible because of dimensional constraints in hallways, doorways and stairways. As a result, customers may have limited selection of furniture because of the size and weight of fully assembled furniture pieces.

Knock-down (KD) or ready-to-assemble (RTA) furniture has been developed in order to overcome such shortcomings and to provide increased options in the storage, delivery and moving of furniture. Unfortunately, early versions of ready-to-assemble furniture lacked strength and stability particularly under heavy loads. The furniture was perceived as flimsy and unreliable particularly as to the means for fastening the components of the furniture pieces. Screws or bolts were used to secure the components which tended to loosen upon extended use resulting in a breakdown of the piece. Such fasteners also do not lend themselves to quick and simple disassembly of the furniture piece requiring tools for removal of the bolts or screws. In some instances, repeated assembly and disassembly of the furniture piece may strip the fasteners ultimately resulting in their failure.

Customers within the display and furniture industries have recognized the need for versatile, portable, durable furniture units which are easy to assemble and disassemble, which will stack compactly for shipping or storage, and will easily reconfigure to meet changing needs. Such functional units of furniture have application as display stands for art galleries, tables and stools for retail and industry use, and furniture for children, trade shows, restaurants, and homes.

Conceptually functional units of furniture such as tables and stools involve the vertical support of a horizontally planar surface (e.g., the top of a given furniture unit) above another horizontally planar surface (e.g., the floor or an attached base of the given furniture unit). Pre-assembled furniture units are often bulky to warehouse, expensive to ship, and cumbersome to move. Furniture units labeled ready-to-assemble (RTA) or knock-down (KD) often require complicated assembly instructions, lengthy time to complete the project, and no guarantee that the completed unit will disassemble and reassemble. Moreover, each furniture unit is likely offered as a set package which combines a predetermined height and width of vertical planar piece(s) with a predetermined length and width of horizontal piece(s). Neither vertical nor horizontal piece(s) can be easily reconfigured to create a different functional unit of furniture.

Using one known technique, the vertical structural members are held together using structural reinforcement members. These structural reinforcement members consist of short wooden dowels. The wooden dowels are inserted horizontally between the vertical structural members at the top and bottom of the vertical structural members to cause self alignment and increased structural integrity. Cams and bolts are used between the vertical structural members and the horizontally top planar surface. If there was a horizontally base planar surface, cams and bolts are also used between the horizontally base planar surface and the vertical structural members. There are problems with using wooden dowels to hold the vertical structural members together. Wooden dowels may break easily, and they have a tendency to swell in humid weather making assembly and disassembly difficult.

Another known technique uses short steel pins as structural reinforcement members instead of wooden dowels. Problems also occur with this technique since the short steel pins are not long enough to penetrate the interior of the vertical structural members sufficiently. With rough handling, the vertical structural members could be torqued out of alignment. This effects structural stability. Thus, despite a large effort expended by designers and manufacturers of furniture, many drawbacks still exist.

What is needed to overcome these problems associated with the prior art, is a ready to assemble article of furniture that has a minimal number of components that are configured to be easily assembled and disassembled without the need of tools, adhesives or other external fastening means.

SUMMARY

In order to address these needs, an interlocking table having an integral magazine holder is provided. The table includes a support assembly having an elongate cross-member, a first end panel having a top edge and an interlocking slot for engagement with an interlocking slot at one end of the cross-member, a second end panel having a top edge and an interlocking slot for engagement with the interlocking slot at the other end of the cross-member, and an intermediate support member having a pair of top edges and an interlocking slot for engagement with an interlocking slot at an intermediate portion of the cross-member. A tabletop panel is supported on the top edges of the end panels and the intermediate support. The article of furniture includes a magazine holder comprising an opening formed in the table top over an intersection point, the intersection point corresponding to a base for supporting magazines inserted through the opening.

DESCRIPTION OF THE FIGURES

Aspects and features of the present embodiments will become apparent as the following description proceeds and upon reference to the drawings, in which.

DESCRIPTION OF THE PREFERRED EMBODIMENT

Figure 1:
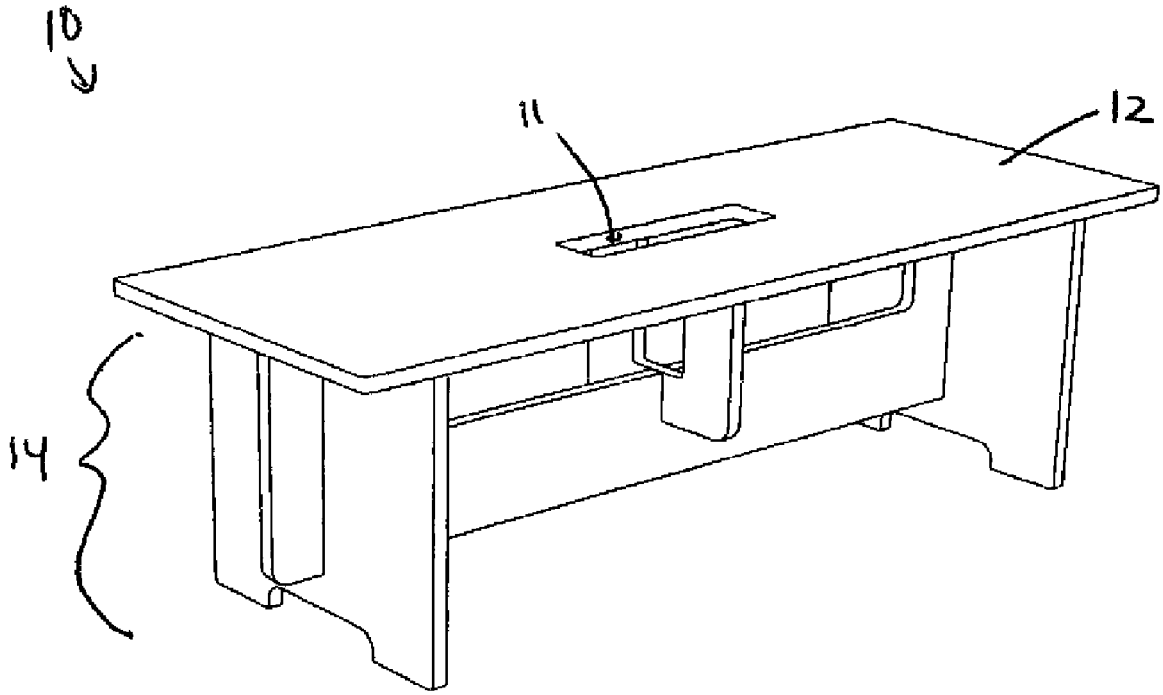
FIG. 1 is a side perspective view of an embodiment of an interlocking table with an integral magazine holder.

For the purposes of promoting an understanding of the principles of the invention, reference will now be made to the embodiments illustrated in the drawings and described in the following written specification. It is understood that no limitation to the scope of the invention is thereby intended. It is further understood that the present invention includes any alterations and modifications to the illustrated embodiments and includes further applications of the principles of the invention as would normally occur to one skilled in the art to which this invention pertains.

Referring to FIGS. 1-5, one embodiment of the ready-to-assemble article of furniture of the present invention is illustrated. In this embodiment, the article of furniture is an interlocking table 10 with an integral magazine holder 11. The table 10 is readily and easily assembled from a few basic components without the use of tools, adhesives or separate fasteners. Specifically, the interlocking table 10 is formed by a planar top surface member, or table top, 12, supported by a support assembly 14. The unique configuration of the table top 12 and support assembly 14 allows the incorporation of a magazine holder 11 into the table. As explained in more detail below, the magazine holder 11 is integral with the table 10 and does not require separate parts or assembly.

Each of the components of the table is preferably formed of wood, either as solid wood elements or as pressed-wood or composite elements. Alternatively, the components can be formed of plastic or any other suitable materials. In any event, in order to maintain the ready-to-assemble attributes of the table 10, the material of the components should be sufficiently rigid, yet light-weight to facilitate the construction of the table.

Figure 3:
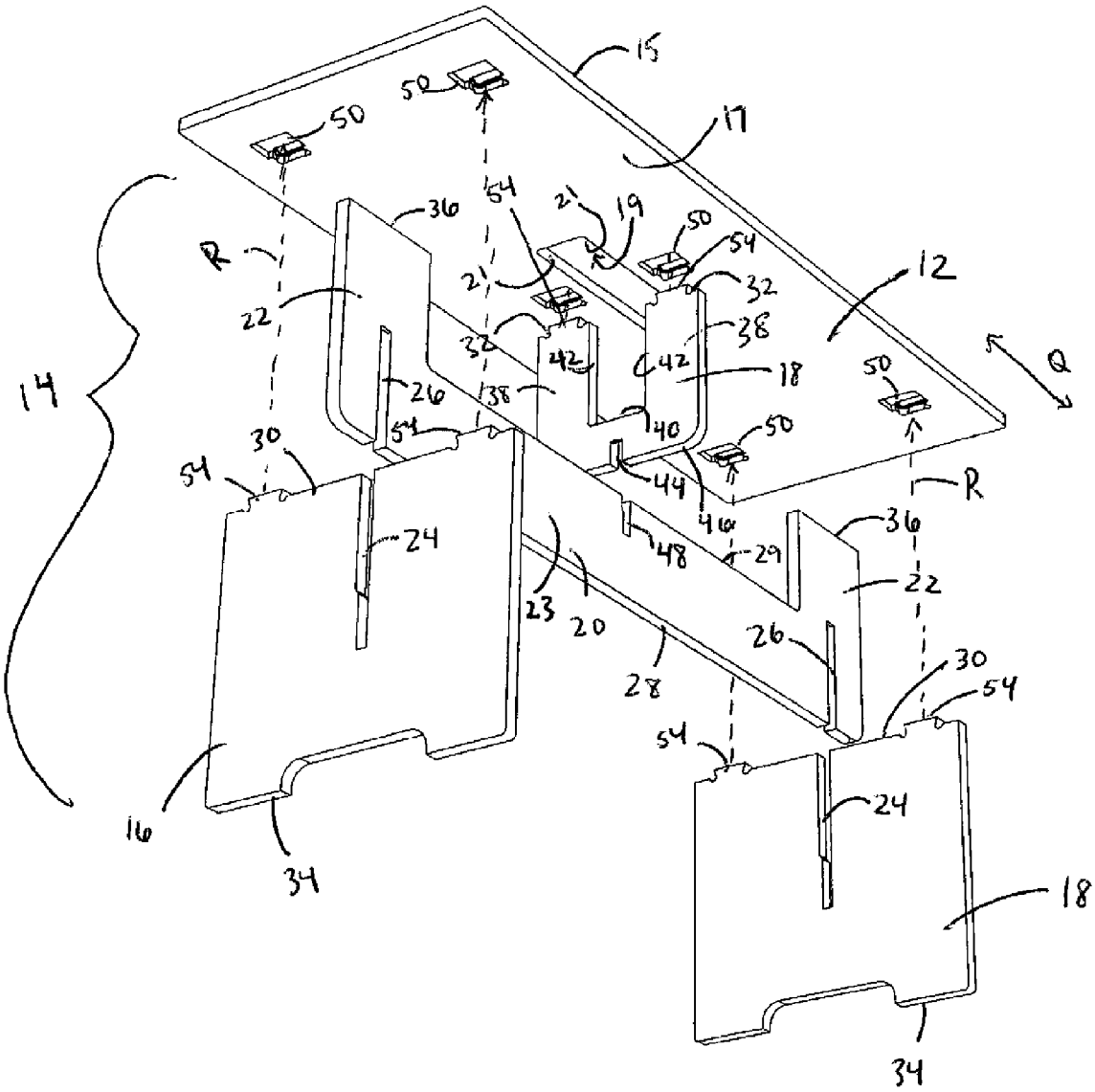
FIG. 3 is an exploded bottom perspective view of the interlocking table of FIG. 1.
Figure 4:
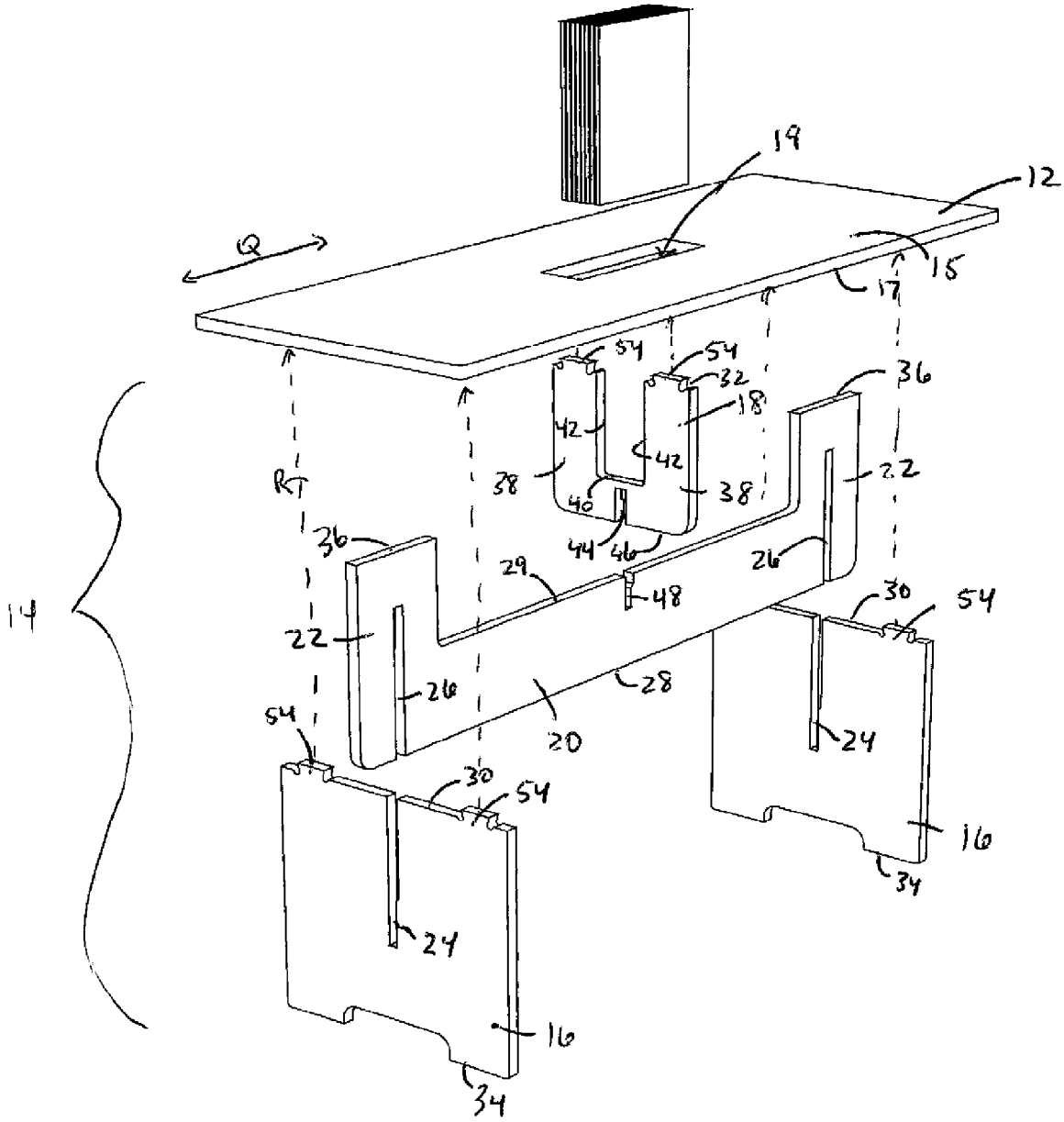
FIG. 4 is an exploded side perspective view of the interlocking table of FIG. 1.

Referring to FIGS. 3 and 4, the support assembly 14 is shown in more detail. The support assembly 14 includes a pair of end support panels 16, an intermediate support panel 18, and a cross-member 20. Each end panel 16 is preferably a similarly sized and shaped rectangular member having a top edge 30 and a bottom edge 34. As will be explained below, the top edges 30 of the end panels 16, in concert with the top edges 32, 36 of the intermediate support panel 18 and cross-member 20, serve as a support edge for supporting the table top 12. The bottom edges 34 of the end panels are configured to contact the floor, and, to this end, may include feet, gliders, casters, etc. for altering the engagement with the floor.

As shown in FIGS. 3 and 4, cross-member 20 is an elongate U-shaped panel having a pair of vertically extending ends 22 connected by a horizontal member 23. The ends 22 of the cross-member are configured to intersect and interlock with the end panels 16 to provide a sturdy free-standing base for supporting the table top 12. In order to interlock the end panels 16 with the ends 22 of the cross-member, the end panels 16 include a downward vertical slot 24 centered in the top edge 30 and extending from the top edge 30 to approximately midway across the panel to the bottom edge 34. Each end of the cross-member 20 has a complementary upward vertical slot 26 extending from the bottom edge 28 of the cross-member to approximately midway the top edge 36 of the support ends 22.

The intermediate panel 18 is a narrow U-shaped member having a pair of vertically extending ends 38. The vertically extending ends 38 each have a top edge 36 for contacting and supporting an intermediate portion of the table top 12 between the end panels 16. The inner edges 42 of the vertically extending ends 38 and the upper edge 40 of the horizontal member of the intermediate support 18 define a holding space for the magazine holder (explained in more detail below). The intermediate support panel 18 includes an upward slot 44 substantially centered between the ends 38 of the panel 18 and extending vertically from the bottom edge 46. The upward slot 44 of the intermediate panel 18 is configured to interlock with a downward slot 48 formed in the horizontal member 23 of the cross-member 20 at an intersection point. In the embodiment of FIGS. 1-5, the downward slot 48 in the cross-member 20 is substantially centered between the ends 22 of the cross-member 20 although, in alternative embodiments, the downward slot 48 may be positioned anywhere between the ends 22 of the cross-member, resulting in an offset of the magazine holder 11 along the length of the table. Preferably, the intermediate panel 18 and the cross-member 20 interlock such that the upper edges 40, 29 of the respective horizontal members are substantially flush. As will be explained below, the flush upper edges at the intersection point form a base for supporting items such as magazines and books for the magazine holder.

To assemble the support assembly 14, the interlocking slots 24, 44 of the end panels 16 and intermediate support panel 18 are received by the respective interlocking slots 26, 44 of the cross-member 20. The top edges 30, 36, 32 of the end panels, cross-member ends and intermediate support panel ends cooperate to define support edges for supporting the table top 12. Thus, the interlocking configuration of the support assembly 14 is configured so that the respective top edges are substantially coplanar to provide an even surface upon which the table top may rest.

Once the support assembly 14 has been assembled, the table top 12 can be positioned on the top edges of the support assembly 14. The table top 12 is a planar member having a top surface 15 and a bottom surface 17. In the embodiment of FIGS. 1-5, the table top 12 has a generally rectangular shape. However, it may have any suitable shape such as square, circular, oval, and the like, depending on the decorating needs of the purchaser. The overall dimensions of the table top 12 and support assembly 14 may be dependent on a number of factors including types of materials, intended use, etc.

Figure 2:
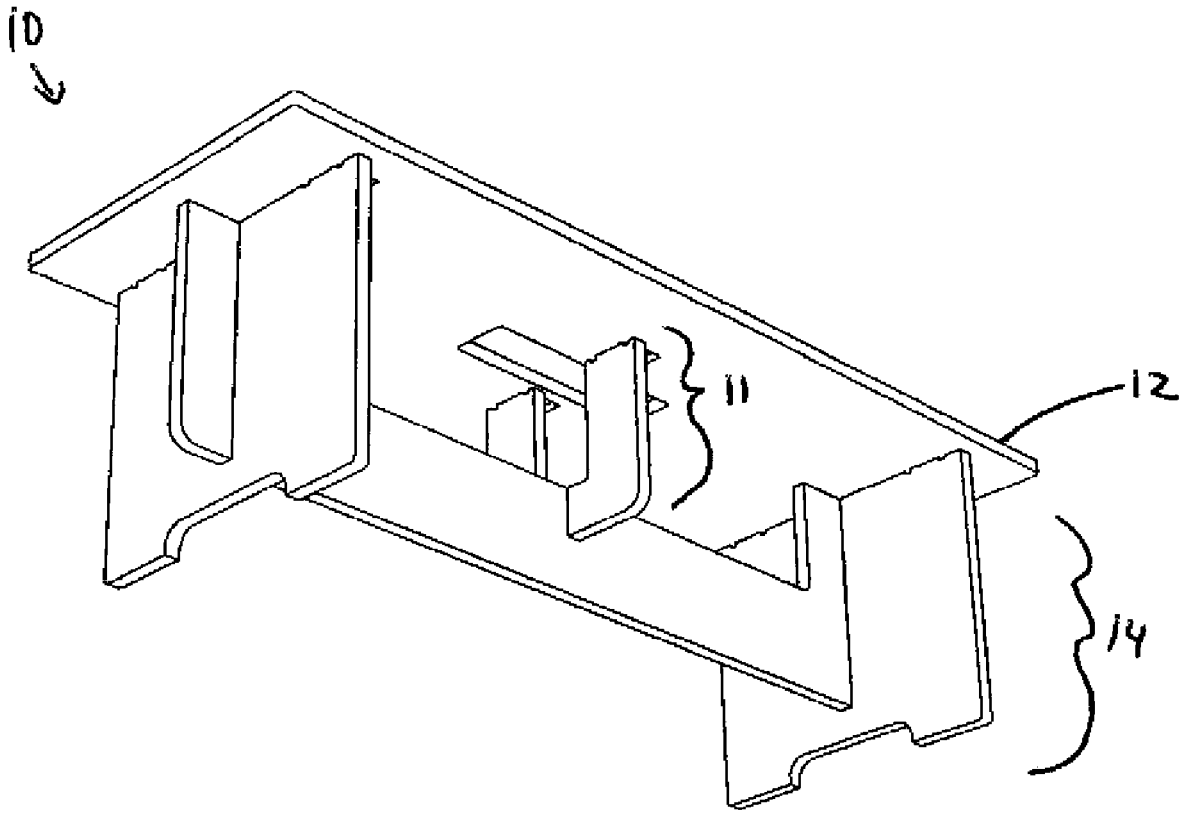
FIG. 2 is a bottom perspective view of the interlocking table of FIG. 1.
Figure 5:
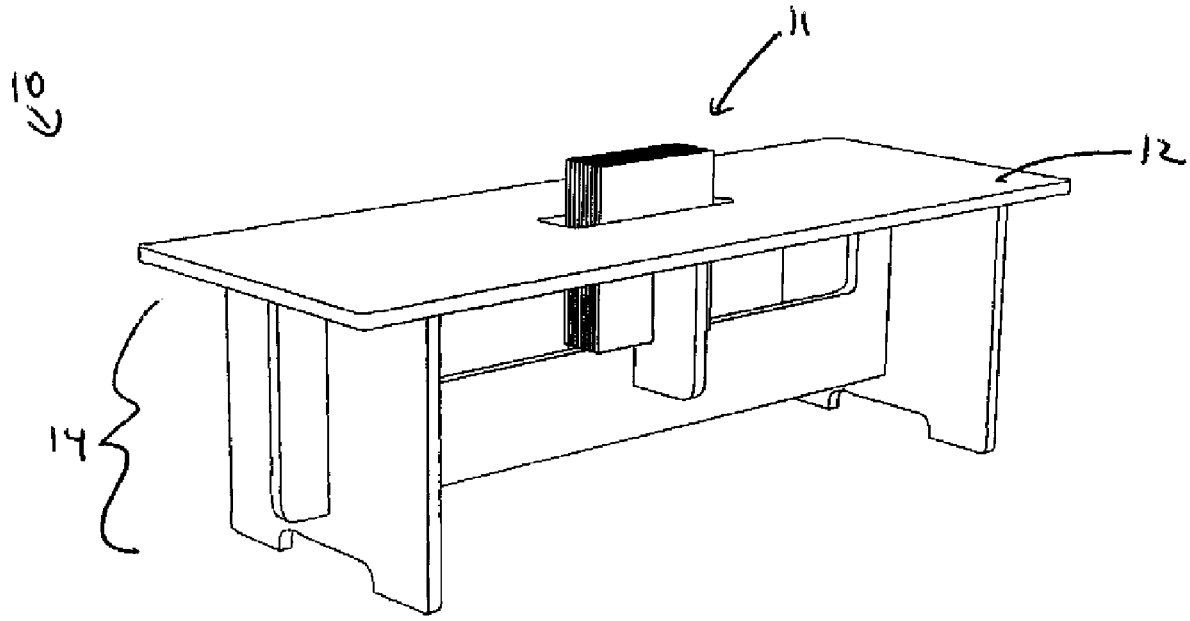
FIG. 5 is a side perspective view of the interlocking table with an integral magazine holder of FIG. 1 in use.

As best shown in FIGS. 1, 2 and 5, the table 10 includes an integral magazine holder 11. The magazine holder 11 comprises an opening 19 (FIGS. 3 and 4) formed in the table top 12 that is sized to allow the insertion at least part way of one or more magazines and/or books. Preferably, the opening 19 in the table top 12 is positioned over the intersection point between the cross-member 20 and the intermediate support panel 18. The opening 19 may be sized, at least in one dimension, such that the inner edges 42 of the vertically extending ends 38 of the intermediate support panel 18 are substantially flush with the lateral sides 21 of the opening 19. Therefore, the intersection point of the cross-member 20 and intermediate support 22 serves as a base for supporting any magazines and/or books inserted into the magazine holder 11, and the vertically extending ends 38 of the intermediate support 18 serve as lateral restraints for maintaining the magazines and/or books in the magazine holder 11.

Because the functional elements of the integral magazine holder 11 are incorporated into the table top 12 and support assembly 14 during fabrication of the respective panels, there is no need for extraneous materials or extra assembly time to include the magazine holder 11 of the table 10. In addition, while a magazine holder has been described, the opening, base support and lateral sides of the holder may be configured for receiving and holding other items besides magazines and/or books, and even a vase for flowers.

To secure the table top 12 to the support assembly 14, a connection system is provided that comprises a plurality of longitudinal guide grooves 50 formed in the bottom surface 17 of the table top 12 and a plurality of locking projections 54 that extend from the top edges 30, 32 of the support assembly 14. The plurality of locking projections 54 and guide grooves 50 are complementarily positioned on the top edges 30, 32 of the assembled support assembly 14 and the bottom surface 17 of the table top, respectively. Generally, the plurality of locking projections 54 is configured to be simultaneously inserted into the plurality of guide grooves 50 orthogonally with respect to the bottom surface 52 of the table as indicated by arrow R in FIGS. 3 and 4. To secure the locking projections in the grooves, the table top is moved with respect to the top edges of the support assembly in a second direction Q so that the inserted locking projections 54 are guided into a locking position in the guide grooves. The second direction Q is dependent on the configuration of the locking projections and the guide grooves. For example, in the embodiments shown, the second direction Q is substantially parallel to the longitudinal axis of the guide grooves 50.

As shown in FIGS. 3 and 4, the locking projections 54 extend vertically from the top edges 30, 32 of the support assembly. Preferably, a locking projection 54 is provided near each end of the top edges 30 of the end panels 16 and on the top edge 32 of each end 38 of the intermediate support panel 18 for a total of six locking projections 54. This configuration ensures that attachment points between the table top 12 and support assembly 14 are distributed substantially evenly across the length and width of the table top 12. However, more or fewer locking projections may be provided.

In one embodiment, the locking projections 54 comprise dovetail-shaped projections for interacting with a complementary dovetail shaped groove portion (explained in more detail below). To simplify fabrication of the respective panels 16, 18, the dovetail shaped profile of the projections 54 may be oriented along the top edges 30, 32 of the panels. Not only does this configuration ensure that each locking projection 54 is oriented in the same direction, it allows the dovetail projections to be formed integrally with the respective panels by simply cutting or trimming the top edges of the panels to form the desired dovetail shapes. However, in alternative embodiments, the projections may be formed separately and then attached to the top edges of the panels.

Figure 6:
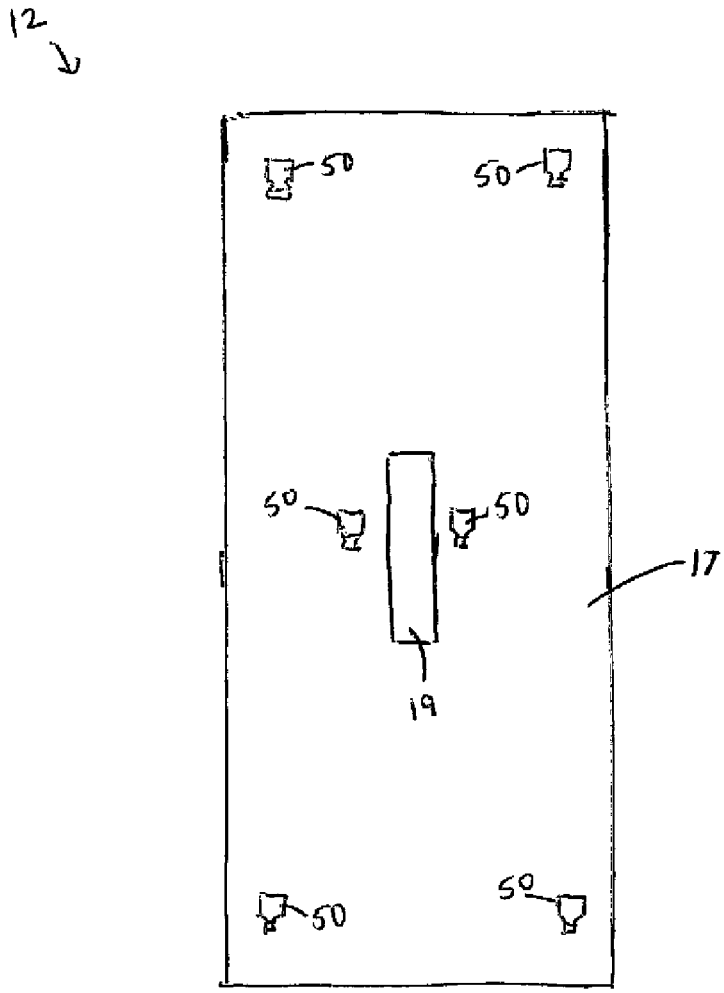
FIG. 6 is a elevational view of the bottom surface of the table top of the table of FIG. 1.
Figure 7:
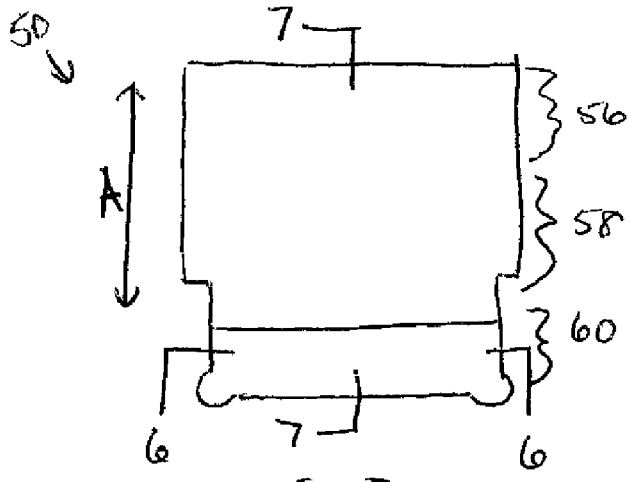
FIG. 7 is an enlarged view of a guide groove shown in FIG. 6.

Referring to FIG. 6, there is shown a view of the bottom surface 17 of the table top 12 with the plurality of guide grooves 50 formed therein. As can be seen, the number and positioning of the guide grooves 50 corresponds to the number and positioning of the locking projections 54 of the support assembly 14. Accordingly, there are six guide grooves 50 formed in the bottom surface of the table top.

Enlarged views of an embodiment of a guide groove 50 are shown in FIGS. 7-11. The exemplary guide groove 50 includes an insertion section 56, a locking section 58, and a longitudinal guide section 60 connecting the insertion 56 and locking sections 60. The insertion section 56 of the groove 50 is dimensioned to allow unobstructed movement of a corresponding locking projection 54 into and out of the groove 50 in an insertion direction I that is substantially orthogonal to the bottom surface 17 of the table top. The guide section 58 is configured to guide an inserted locking projection 54 longitudinally along the guide groove between the insertion section 56 and the locking section 60 of the groove in response to translation of the table top with respect to the support edges of the support assembly in a direction that is substantially parallel to the longitudinal axis A of the groove. For a description of an embodiment of a guide groove that is configured to guide an inserted locking projection longitudinally along the guide groove between the insertion section and the locking section of the groove in response to rotation of the table top with respect to the support edges of the support assembly refer to co-pending application Ser. No. 11/697,420 filed Apr. 6, 2007, the entire disclosure of which is hereby incorporated by reference herein.

Figure 8:
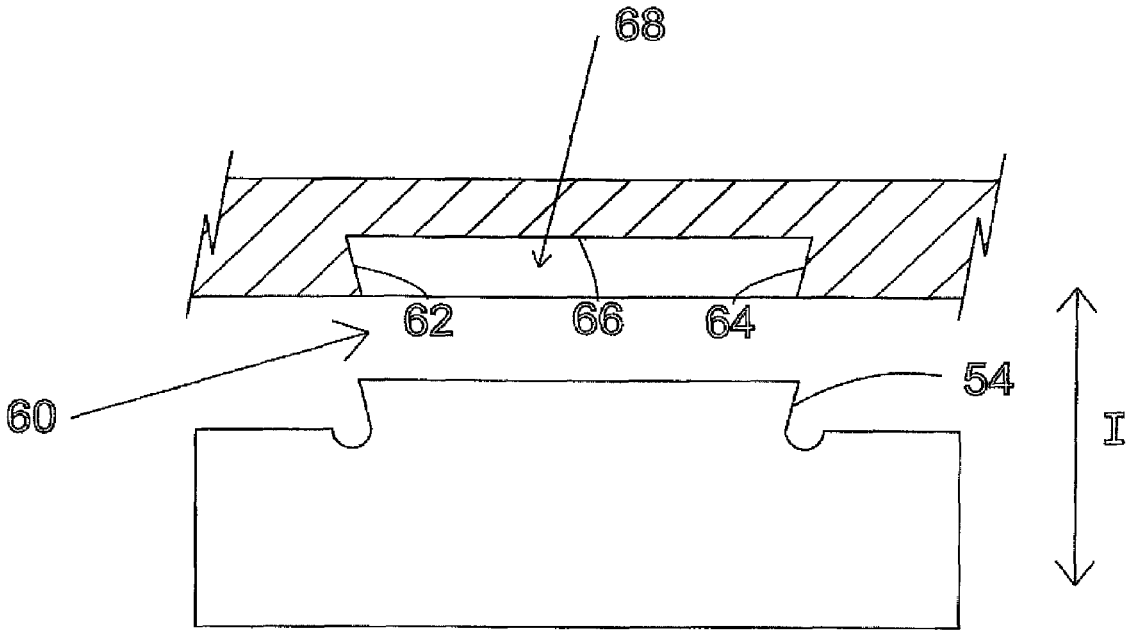
FIG. 8 is an enlarged cross-sectional view of the guide groove taken along lines 6-6 of FIG. 7.
Figure 10:
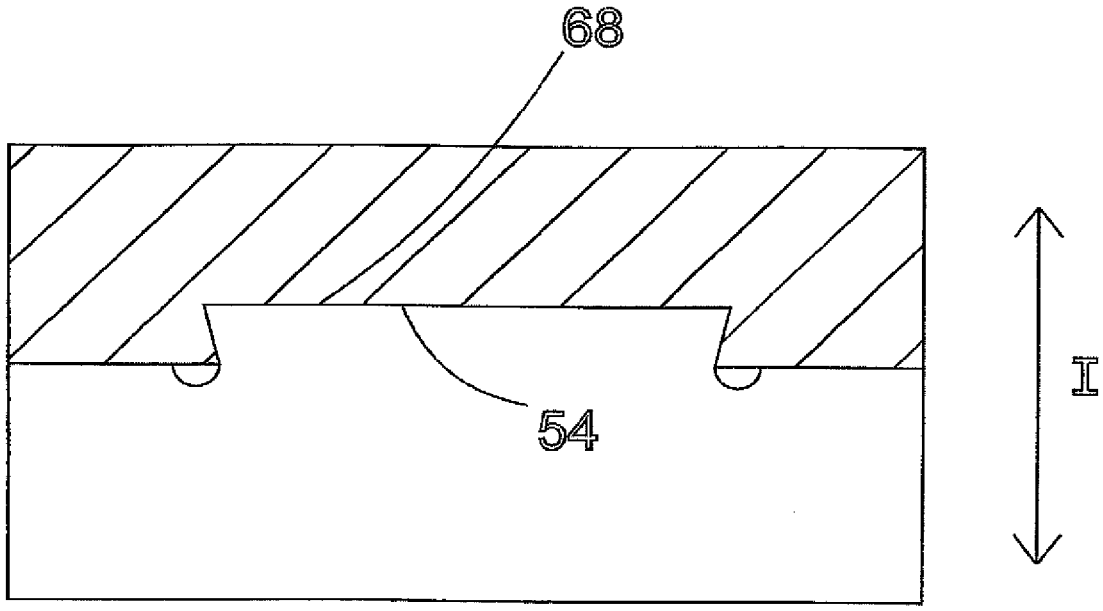
FIG. 10 is a further enlarged cross-sectional view of the guide groove taken along lines 6-6 of FIG. 7.
Figure 11:
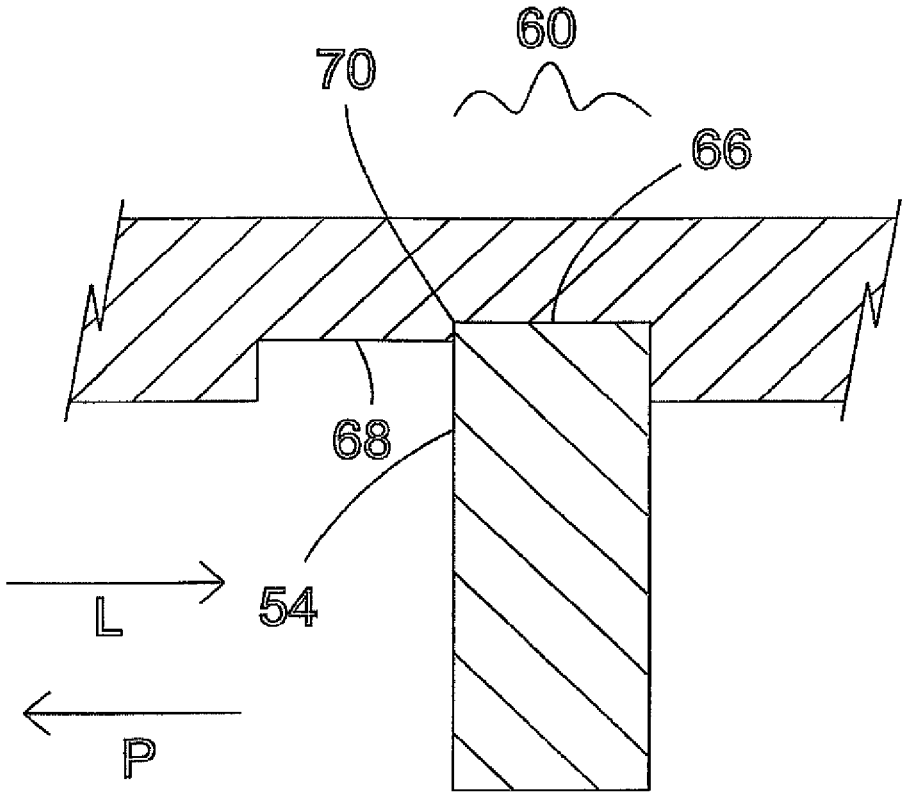
FIG. 11 is another enlarged cross-sectional view of the guide groove taken along lines 7-7 of FIG. 7.

Once a locking projection 54 has been received in a locking section 60 of a groove, the locking section 60 is configured to secure the locking projection to prevent orthogonal, or vertical, movement of the locking projection with respect to the bottom surface of the table as well as to prevent longitudinal movement of the projection back toward the insertion section of the groove. Referring to FIG. 8, the locking section of the guide groove includes sidewalls 62 and 64, and a base wall 66. The side walls 62, 64 and base wall 66 cooperate to define an undercut region 68 configured to slidingly receive the locking projections 54 upon rotation of the table top with respect to the support member. The undercut region 68 and the locking projections 54 are preferably complementarily shaped as shown in FIGS. 8 and 10. The undercut region 68 and complementary shaped locking projection 54 interact to limit or prevent orthogonal movement of the locking projections 54 into and out of the locking section of the groove 50.

Figure 9:
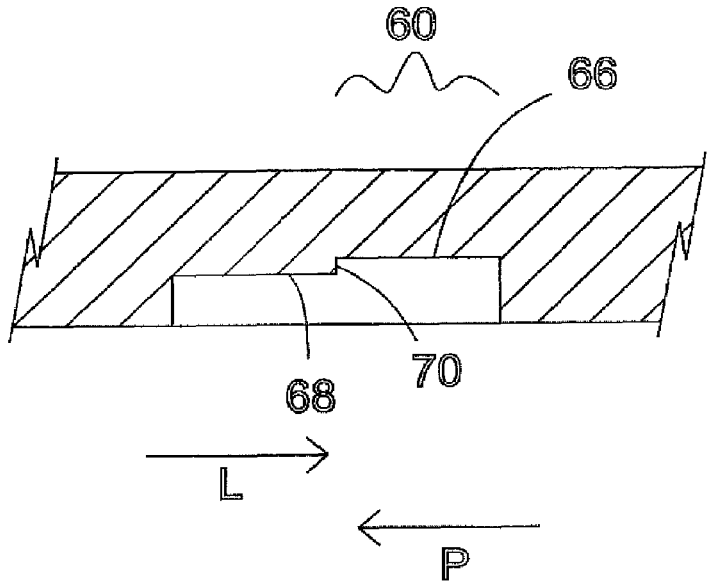
FIG. 9 is an enlarged cross-sectional view of the guide groove taken along lines 7-7 of FIG. 7.

The locking section 60 of the guide grooves 50 may include any suitable structure or configuration for preventing lateral movement of a locking projection 54 toward the insertion section 56 of the guide groove. In one embodiment, the base wall 66 of the locking section of the groove 50 is vertically offset from the base 68 of the guide section of the groove as shown in FIG. 9. The offset base wall 66 of the locking section defines a retaining edge, or lip, 70 on the inner side of the locking section 60. The retaining edge 70 is configured to allow passage of a locking projection into the locking section of the groove in direction L. Once the locking projection 54 passes over the retaining edge 70, the offset base wall 66 of the locking section allows at least a slight vertical movement of the projection 54 relative to the groove 50 so that, in effect, the projection becomes seated in the locking section 60 (see FIG. 11). The retaining edge 70 then abuts the locking projection 54 thereby obstructing movement of the locking projection toward the insertion section of the groove in direction P. It can be appreciated that, in this embodiment, gravity contributes to the downward force necessary to keep the top edge of the locking projection 54 engaged with the offset base wall 66 thereby maintaining the abutting relationship between the retaining edge 70 of the locking section and the side of the locking projection 54.

To remove the table top from the support member, the table top is moved vertically with respect to the support member so that the top edge of the locking projections 54 is no longer in an abutting relation with the retaining edge 70 of the locking section of the grooves. The table top 12 may then be translated with respect to the support assembly along axis L so that the locking projections 54 are slidingly guided from the locking section 60 of the groove to the insertion section 56 at which point the locking projections 54 may be removed from the grooves 50.

Although the locking projections 54 and guide grooves 50 have been described as having a complementary dovetail shape, other suitable shapes and/or configurations may be implemented. For example, the grooves and projections may be T-shaped, L-shaped, etc. Moreover, although, the locking section has been described as having a vertically offset base wall configured to limit lateral movement of the locking projections, other suitable configurations are contemplated. For instance, instead of being offset, the base of the groove may include a detent adjacent the locking section that includes a ramped edge on one side to allow movement toward the locking section and a flat edge on the inner side of the locking section that acts in a manner similar to the retaining edge, or lip, described above.

What has been described thus far is five panels which constitute support panels and a top surface of a table. All five panels interlock to provide a sturdy structure that may be easily assembled and disassembled by hand and that does not require the use of tools, adhesives, or other fastening means to construct. The translate-to-lock feature for fastening the table top to the support member is particularly advantageous because it provides a secure connection that is both easy to assemble and resistant to inadvertent dislodgment or disconnection. In addition, the unique configuration of the panels and the connection system allows the incorporation of an integral magazine holder that adds to the functionality of the table without adding to the complexity, materials, or assembly time of the table.

Another benefit of the ready-to-assemble articles of furniture described above is that manufacture and assembly of the table does not necessarily have to be harmful to the environment. For example, because extraneous fastening means are not required, toxic and environmentally hazardous adhesives may be avoided. In addition, the panels may be formed from reclaimed or renewable wood sources, recycled or recyclable materials, etc. Thus, in some embodiments, the articles of furniture of the present invention may be considered environmentally "friendly."

It should be readily apparent to those of ordinary skill in the art that the connection system of the present invention may be useful in the connection of planar members to support structures for articles of furniture such as stools, chairs, display stands, etc. It should be further apparent that this connection system only minimally dictates the overall configuration of the connected components. While the placement of the guide grooves and locking projections must be consistent, all other features of the connected panels may be modified as needed for aesthetic or functional reasons.

While the invention has been illustrated and described in detail in the drawings and foregoing description, the same should be considered as illustrative and not restrictive in character. It is understood that only the preferred embodiments have been presented and that all changes, modifications and further applications that come within the spirit of the invention are desired to be protected.

What is claimed is:

1. An article of furniture comprising:

a support assembly including:

an elongate cross-member including a pair of vertically extending ends connected by a first horizontal member, each vertically extending end having a top edge and an interlocking slot, the first horizontal member having an upper edge and an interlocking slot;

a first end panel having a top edge and an interlocking slot for engagement with the interlocking slot at one end of the cross-member;

a second end panel having a top edge and an interlocking slot for engagement with the interlocking slot at the other end of the cross-member; and an intermediate support member having a pair of vertically extending ends connected by a second horizontal member, each vertically extending end of the intermediate support member including a top edge and an inner edge, the second horizontal member including an upper edge and an interlocking slot for engagement with the interlocking slot of the first horizontal member;

a table top panel supported on the top edges of the end panels and the vertically extending ends of the cross-member and the intermediate support, the table top panel having a longitudinal axis;

a connection system for connecting the table top panel to the support assembly; and a magazine holder including an opening formed in the table top over an intersection point between the first horizontal member and the second horizontal member and between the inner edges of the vertically extending ends of the intermediate support, the intersection point corresponding to a base for the magazine holder, the inner edges corresponding to lateral sides of the magazine holder.

2. The article of furniture of claim 1, wherein the connection system comprises:

a plurality of locking projections extending from the top edges of the end panels and the intermediate support member and oriented substantially perpendicular to the longitudinal axis of the table top; and a plurality of longitudinal guide grooves in a bottom surface of the table top panel in positions corresponding to the plurality of locking projections, the plurality of guide grooves being configured to receive the plurality of locking projections inserted orthogonally with respect to the bottom surface of the table top and to guide the inserted projections into a locking position in response to movement of the table top panel with respect to the support assembly along the longitudinal axis.

3. The article of furniture of claim 2, wherein each guide groove includes an insertion section, a guide section and a locking section, the insertion section of each of the guide grooves being configured to allow movement of a respective locking projection into and out of the guide groove orthogonally with respect to the bottom surface;

the guide section of each guide groove being configured to guide a respective locking projection between the insertion section and the locking section in response to movement of the table top with respect to the support assembly along the longitudinal axis of the table top; and the locking section of each groove being configured to receive the locking projection from the guide section and to prevent orthogonal movement of the received locking projections out of the groove.

4. The article of furniture of claim 3, wherein the locking sections of the guide grooves and locking projections received in the locking sections are configured to cooperate to prevent movement of the table top relative to the support assembly along the longitudinal axis of the table top.

5. The article of furniture of claim 4, wherein the plurality of locking projections includes a locking projection positioned at each end of the top edge of each end panel and a locking projection on each of the top edges of the intermediate support member.

6. The article of furniture of claim 5, wherein the locking section of the guide grooves includes a pair of side walls and a base wall that define an undercut region for receiving the locking projections from the guide section, the locking projections being complementarily shaped to the undercut regions so that orthogonal movement of the locking projection out of the groove is prevented.

7. The article of furniture of claim 6, wherein the undercut region and locking projections are dovetail-shaped.

8. The article of furniture of claim 7, wherein the base wall of the locking section is offset from the guide section of the groove, the offset base wall defining a retaining lip on an inner side of the locking section that is configured to allow movement of a corresponding locking projection into the locking section of the groove and to abut the locking projection in the locking section to prevent movement of the projection toward the insertion section of the groove.

9. An article of furniture comprising:

a table top panel having a first end, a second end, a bottom surface, a top surface;

a first end panel having a top edge for supporting the first end of the table top panel and an interlocking slot;

a second end panel having a top edge for supporting the second end of the table top panel and an interlocking slot;

a cross-member extending between the first and second panels, the cross-member including an interlocking slot at each end thereof for engagement with the interlocking slots of the first and second end panels, and an upper edge such that is spaced from the bottom surface of the table top when the end panels and the cross-member are interlocked;

an intermediate support member arranged between the first and second end panels, the intermediate support member including a horizontal member and a pair of vertically extending ends positioned at each end of the horizontal member, each vertically extending end having a top edge for supporting an intermediate portion of the table top panel, the horizontal member having an interlocking slot for engagement with an interlocking slot on the cross-member at an intersection point, the horizontal member including an upper edge that is substantially coplanar with the upper edge of the cross-member when the intermediate support and the cross-member are interlocked; and a connection system for releasably securing the table top panel to the top edges of the end panels and the intermediate support member;

wherein the table top panel includes an opening over the intersection point between the horizontal member and the cross-member and between the vertically extending ends of the intermediate support member.

10. The article of furniture of claim 9, wherein the connection system includes a plurality of locking projections extending from top edges of the end panels and the intermediate support and a plurality of guide grooves on the bottom surface of the table top panel in positions corresponding to the plurality of locking projections; and wherein the plurality of locking projections are configured to be simultaneously received in the plurality of guide grooves in an insertion direction and moved between the insertion section of the groove and a locking section of the groove in response to translational movement of the table top with respect to the top edges.

11. The article of furniture of claim 10, wherein the insertion section of the guide grooves are configured to allow unobstructed movement of the locking projections into and out of the guide grooves orthogonally with respect to the bottom surface of the table top panel.

12. The article of furniture of claim 11, wherein the guide grooves include a longitudinal guide section, the guide section being configured to guide the locking projections from the insertion section to the locking section in response to the translational movement between the table top panel and the top edges of the end panels and the intermediate support member.

13. The article of furniture of claim 12, wherein the locking sections of the grooves are configured to receive the locking projections, and to prevent orthogonal movement of the received locking projections out of the locking sections of the grooves.

14. The article of furniture of claim 13, wherein the locking section of the guide grooves and locking projection received in the locking section are configured to cooperate to prevent movement of the locking projection toward the insertion section of the guide grooves.

15. The article of furniture of claim 14, wherein the locking section of the guide grooves includes a pair of side walls and a base wall that define an undercut region for receiving the locking projections upon the relative rotation between the planar member and the support in a first direction of rotation, the locking projections being complementarily shaped to the undercut regions so that orthogonal movement of the locking projection out of the groove orthogonally with respect to the bottom surface of the planar member is prevented.

16. The article of furniture of claim 15, wherein the undercut region and locking projections are dovetail-shaped.

17. The article of furniture of claim 15, wherein the base wall of the locking section is offset from the guide section of the groove, the offset base wall defining a retaining lip on an inner side of the locking section that is configured to allow movement of a corresponding locking projection into the locking section of the groove and to abut the locking projection in the locking section to prevent movement of the projection toward the insertion section of the groove.

* * * * *